US005642806A

United States Patent [19]

Karadimas

[11] Patent Number: 5,642,806

[45] Date of Patent: Jul. 1, 1997

[54] ROCKER ACTUATED SWITCH ASSEMBLY

[75] Inventor: Margaret Karadimas, Bloomingdale, Ill.

[73] Assignee: Eaton Corporation, Cleveland, Ohio

[21] Appl. No.: 612,150

[22] Filed: Mar. 7, 1996

[51] Int. Cl.[6] ..... H01H 21/24

[52] U.S. Cl. ..... 200/557; 200/562; 200/302.3

[58] Field of Search ..... 200/557, 553, 200/562, 339, 302.3, 554, 555, 556, 558, 559, 560, 561, 563

[56] References Cited

U.S. PATENT DOCUMENTS

| | | | |
|---|---|---|---|
| 3,246,087 | 4/1966 | Haviland | 200/339 |
| 3,879,572 | 4/1975 | Comerford et al. | 200/557 |
| 3,927,285 | 12/1975 | Frost et al. | 200/557 |
| 4,169,972 | 10/1979 | Black, III et al. | 200/557 |
| 4,531,027 | 7/1985 | Vogt et al. | 200/557 |
| 4,843,200 | 6/1989 | Parlatore et al. | 200/339 |
| 5,446,253 | 8/1995 | Oshgan | 200/557 |

*Primary Examiner*—David J. Walczak
*Attorney, Agent, or Firm*—Roger A. Johnston

[57] ABSTRACT

A switch housing or rocker actuator with a pair of oppositely directed pivot trunnions journaled in a housing with a lever portion extending through the housing and sealed by a flexible boot. A generally "W" shaped flat plastic centering spring with a central aperature is assembled over the lever and registered on the trunnions to form a rocker sub-assembly which is inserted in the housing with a pre-placed boot. The centering spring has the reaction ends barbed for frictionally engaging the inner surface of the housing.

9 Claims, 3 Drawing Sheets

ROCKER ACTUATED SWITCH ASSEMBLY

BACKGROUND OF THE INVENTION

The present invention relates to rocker actuated type switches and particularly switches of the type employed for low voltage applications such as encountered in automotive usage for occupant remote control of accessories. Such switches have found particular use in automotive applications control of accessories such as window lift motors, doorlock solenoids, outside rearview mirror adjust motors and windshield and back light window defrost heaters.

Rocker switches employed for automotive accessory control typically have a rocker actuator member pivotable about an axis and mounted on a switch housing with the rocker member sealed by a flexible boot or bellows to prevent contamination from entering the switch housing and fouling the switch contacts. In certain switching applications, the rocker actuator may carry a movable contact which can operate as a shorting bar between a pair of spaced stationary contacts. This arrangement has found to be particularly suitable for automotive applications, operating at relatively low voltages, because the movable contact on the rocker can make wiping contact with the stationary contacts which provides for cleaning of the contacts.

However, switches of the aforesaid type for automotive applications are often desired to have a self centering or return to neutral actuation mode; and, heretofore such switches have relied upon the inherent elastic properties of the sealing boot to provide for a self centering return to neutral function. This arrangement has found to have the disadvantages of requiring a relatively heavy seal boot to provide the spring action to return the actuator to the neutral position. This has resulted in additional costs for the boot and increased resistance to switch actuation. Furthermore, deterioration or changes in the properties of the elastomeric boot over time have tended to relax the spring forces of the elastomeric boot and the switches have experienced a tendency to stick or stay in the actuated position after the user removes the applied force from the rocker actuator.

Where auxiliary mechanical springs have been considered for the self centering or return to neutral bias for the rocker actuator in such switches, it has been found extremely costly and difficult in assembly to provide plural springs in the switch for returning the actuator to the neutral position.

Thus it has been desired to provide a way or means of providing an easy to assembly relatively simple and low cost technique for providing a self centering or return to neutral function for a rocker actuated switch and particularly for such switches employed in automotive applications.

SUMMARY OF THE INVENTION

The present invention provides a relatively low cost and simple technique for providing self centering or return to neutral function for a rocker actuated switch and particularly for a switch suitable for automotive accessory control applications. The switch of the present assembly has a rocker actuator with a movable shorting bar contact thereon which is assembled in a switch housing for pivotal movement about an axis with a lever portion of the rocker extending externally of the housing through an opening at generally right angles to the axis of movement. A generally "W" shaped flat strip type spring formed of non-metallic and preferably plastic material is received over .the lever portion and has the ends thereof barbed for engaging the walls of the housing. The rocker and the spring may be formed as a subassembly and inserted into the housing through a pre-placed elastomeric sealing boot which seals between the housing and the lever portion. The spring and rocker arrangement of the present invention provides for a low cost and rapid assembly of the switch in high volume mass production.

DETAILED DESCRIPTION

Figure 1:
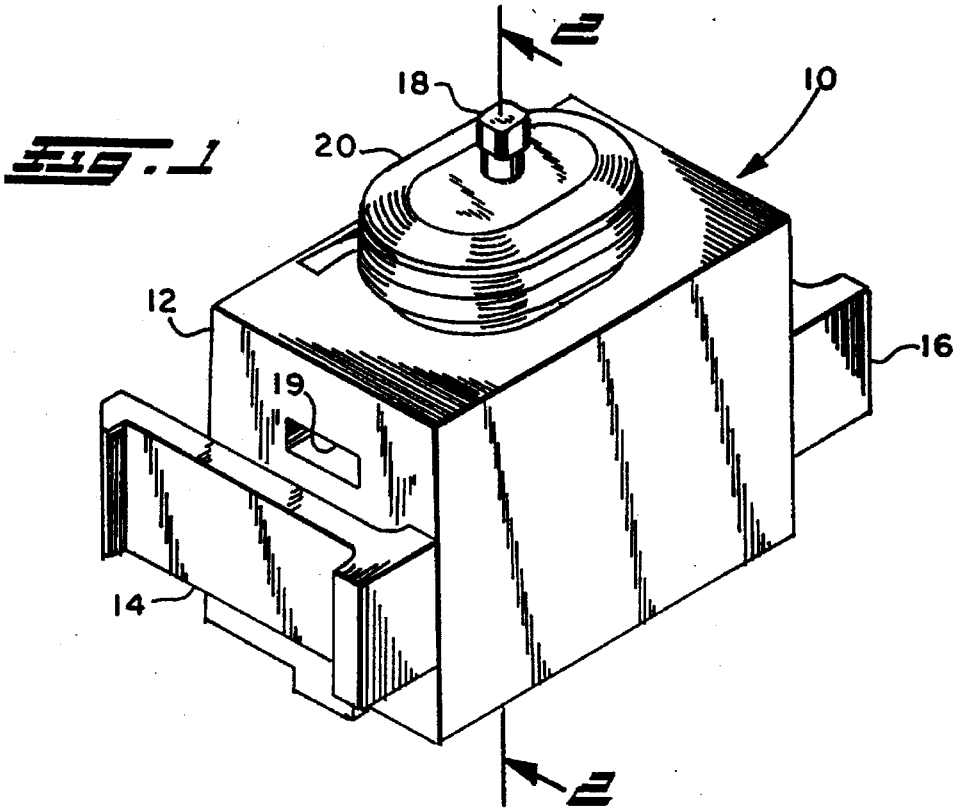
FIG. 1 is an axonometric view of the assembled switch of the present invention.
Figure 2:
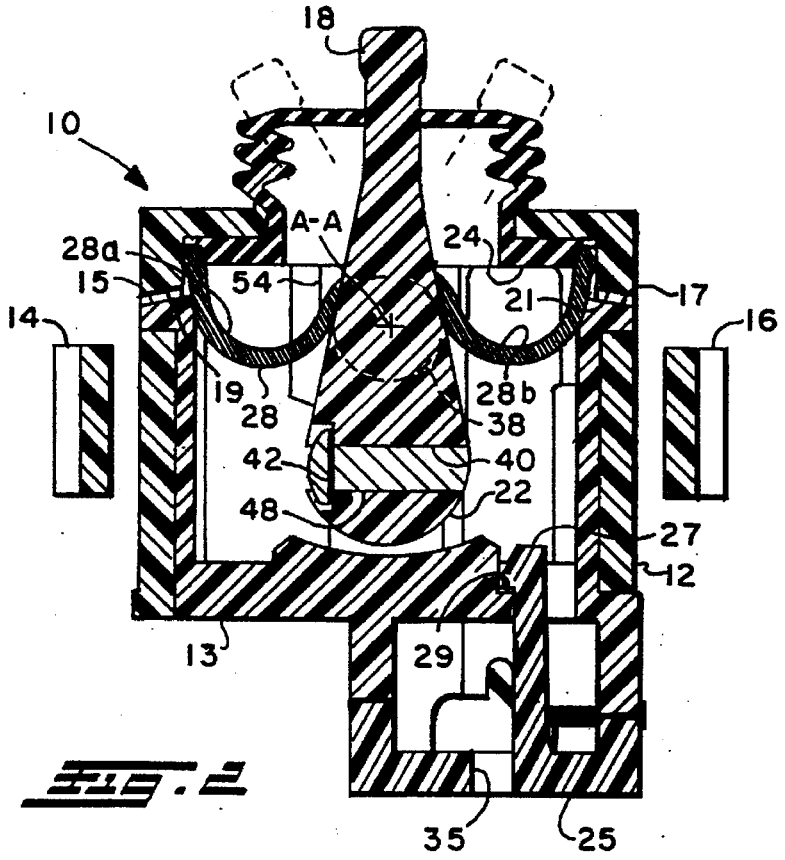
FIG. 2 is a section view taken along section indicating lines 2—2 of FIG. 1.
Figure 3:
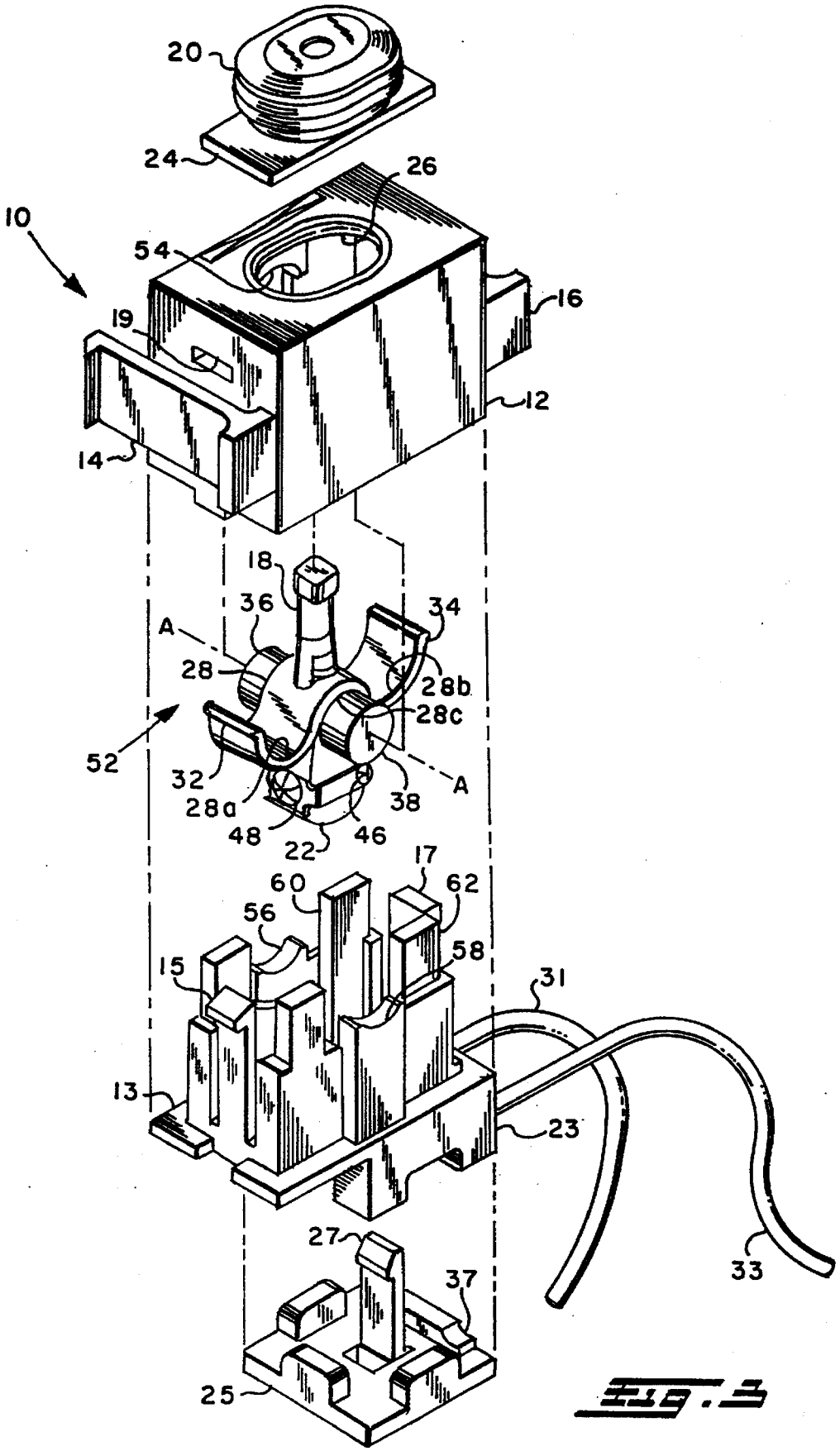
FIG. 3 is an exploded view of the switch of FIG. 1.

Referring to FIGS. 1, 2 and 3 the switch assembly of the present invention is indicated generally at 10 and includes housing means including a cover 12 having mounting clips integrally formed thereon and extending from opposite sides thereof as denoted by reference numerals 14, 16. Cover 12 is received over a base 13 and secured thereon by locking tabs 15, 17 engaging slots 19, 21 formed in the cover. The switch has an actuator lever portion 18 extending through the top of the housing and sealed there around by a boot or bellows 20.

Base 13 has an electrical connection receptacle portion 23 formed on the bottom thereof with a closure 25 received thereover and secured thereto by a locking tab 27 which engages an opening 29 formed in the base 13. Electrical leads 31, 33 extend from the receptacle through apertures 35, 37.

Referring to FIG. 2, the switch assembly 10 is shown in cross section with the internal switching contacts omitted for the sake of simplicity. The rocker lever 18 is shown as formed integrally with a rocker member 22 which is disposed for pivotal movement about an axis A—A in either clockwise or counterclockwise direction as denoted by the dashed outlines in FIG. 2. The bellows 20 has a flange 24 formed around the lower periphery thereof which is registered against the under surface of the top of the housing 12; and, the upper portion of the bellows extends through an aperture 26 formed in the upper portion or top of housing 12.

A nonmetallic preferably plastic centering or return to neutral spring indicated by reference numeral 28 is disposed over the lever portion 18 of the rocker member and has the ends thereof registered against the inner wall of the housing 12.

Figure 4:
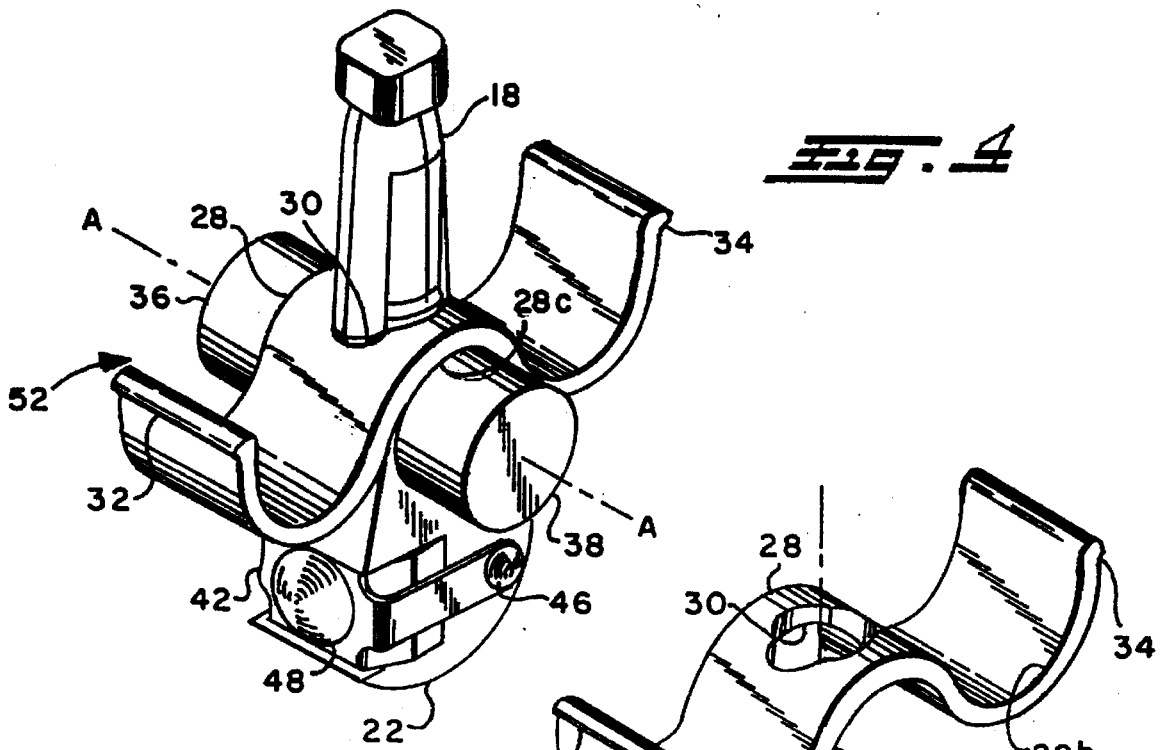
FIG. 4 is an axonometric view of the rocker and spring subassembly of the switch of FIG. 1.
Figure 5:
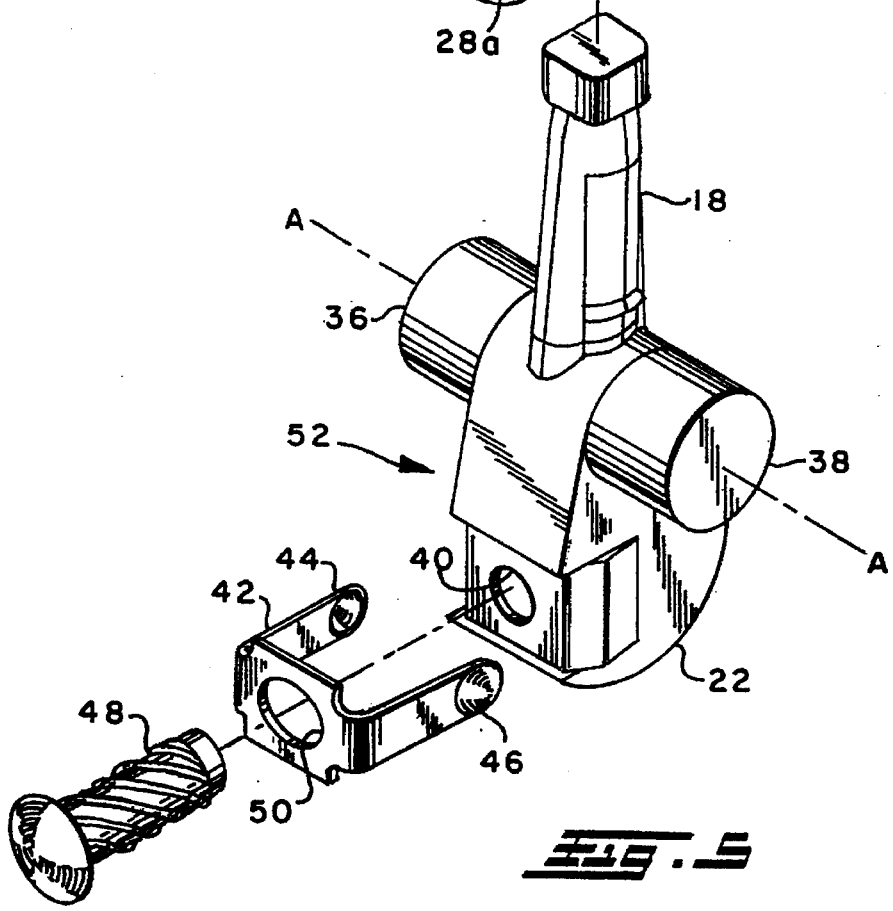
FIG. 5 is an exploded view of the subassembly of FIG. 4.

Referring to FIGS. 3, 4 and 5, the spring 28 is formed of plastic material having a relatively thin flat transverse section and a contra curved or "W" shaped configuration with a central opening 30 formed therein and barbs 32, 34 formed on the opposite reaction ends thereof for frictionally engaging the interior of the housing 12. The spring is received over the rocker 22 with the lever portion extending through opening 30; and, the central concave downward portion of the spring 28*c* is registered against oppositely extending trunnions 36, 38 formed on the rocker 22.

In the presently preferred practice of the invention, spring 28 is formed of acetal plastic material available under the trade name "CELCON" M25 and has preferably a hardness in the range 78 measured on the "M" scale. The trunnions extend in oppositely directed, aligned arrangement to define the pivot axis denoted by the reference characters A—A in FIGS. 2, 3, 4 and 5. Referring to FIG. 5, the rocker has a bore 40 formed therein in the lower portion thereof below the trunnions; and, a generally "U" shaped shorting bar 42 having wiper contacts 44, 46 formed on the ends of the legs thereof is received over the rocker and retained by a press fitting fastener 48 through an aperture 50 provided in the closed end of the contact 42. The rocker 22, spring 28, contact 42 and fastener 48 are assembled as shown in FIGS. 4 and 5 to form a subassembly indicated generally at 52.

Referring to FIG. 3, the assembly 52 may then be inserted into the housing from the underside thereof such that the trunnions 36, 38 register in appropriate saddles, portions of which are provided on the interior of the cover one of which is visible in FIG. 3 and denoted by reference numeral 54 and other portions of which are formed on the base 13 as denoted by reference numerals 56, 58 in FIG. 3. It will be understood that a similar unshown saddle is provided on the opposite side of the interior housing 12 for registration of the trunnion 38 thereagainst. Upon insertion of the subassembly 52 into the housing 12, ends 32, 34 of spring 28 are compressed to frictionally engage the interior of the housing 12 and thereby provide compression of the upwardly concave portions 28*a*, 28*b* of the spring 28. It will be understood that the boot 20 is replaced in the housing with the flange 24 registered against the undersurface of the top of the housing before the rocker assembly 52 is inserted into the housing.

It will also be understood that upon user movement of the rocker lever 18 to either of the positions shown in dashed outline in FIG. 2, the supporting bar contacts 44, 46 are wiped against stationary contacts 60, 62 (see FIG. 3) provided on the interior of the housing for providing an electrical switching function.

The present invention thus provides a unique centering or return to neutral spring for a rocker type switch particularly suitable for automotive accessory control applications and enables simplified and reduced-cost assembly operations in manufacturing of the switch. The switch assembly of the present invention provides a positive centering or return to neutral force which is unrelated to the properties of the elastomeric sealing boot provided over the rocker.

Although the invention has been described above with respect to the illustrated embodiment, it will be understood that the invention is capable of variations and modifications and is limited only by the scope of the following claims.

I claim:

1. A rocker actuated switch assembly comprising:

(a) housing means including a pair of oppositely disposed generally parallel side walls;

(b) a rocker member mounted in said housing means for pivotal movement about an axis extending in a first direction and having a lever portion thereof extending exteriorly of said housing means through an opening therein and in a direction generally normal to said axis, said rocker member having an electrical contact member thereon disposed on a side of said axis opposite said lever portion, wherein upon a user effecting said pivotal movement said contact is moved in opposite directions thereby providing an electrical switching function; and, (c) a centering spring received over said lever portion of said rocker, said spring having a generally thin, flat transverse section with portions of contra curvature intermediate the ends thereof, with one end frictionally engaging said housing means on each of said oppositely disposed side walls, wherein said spring is operative upon user movement of said rocker about said axis in either a clockwise or anti-clockwise direction to return said rocker to a neutral or centered position.

2. The switch defined in claim 1, wherein said spring has a generally "W" shaped configuration.

3. The switch defined in claim 1, wherein said spring is formed of non-metallic material.

4. The switch defined in claim 1, wherein said spring is formed of plastic material.

5. The switch defined in claim 1, wherein said spring is formed of acetal plastic material.

6. The switch defined in claim 1, wherein said spring is formed in a generally "W" shaped configuration with a centrally located aperture therein having said lever portion of said rocker member received therethrough.

7. The switch assembly defined in claim 1, wherein said spring has a relatively thin generally flat configuration in transverse section and has a barb formed on each end thereof for engaging said housing means.

8. The switch assembly defined in claim 1, further comprising a flexible elastomer seal member disposed in sealing relationship between said rocker member lever portion and said housing means opening.

9. The switch assembly defined in claim 1, further comprising an elastomer member operative for flexibly sealing between said rocker member lever portion and said opening in said housing means.

* * * * *